United States Patent [19]

Strijker

[11] 4,110,905

[45] Sep. 5, 1978

[54] SHAVING APPARATUS WITH BAND CUTTER

[75] Inventor: Hendrik Willem Strijker, Drachten, Netherlands

[73] Assignee: U.S. Philips Corporation, New York, N.Y.

[21] Appl. No.: 807,021

[22] Filed: Jun. 16, 1977

[30] Foreign Application Priority Data

Jul. 12, 1976 [NL] Netherlands ..... 7607681

[51] Int. Cl.[2] ..... B26B 19/16

[52] U.S. Cl. ..... 30/43.6; 30/40.1

[58] Field of Search ..... 30/43, 43.4, 43.5, 43.6, 30/40.1, 346.51

[56] References Cited

U.S. PATENT DOCUMENTS

| | | | |
|---|---|---|---|
| 1,318,456 | 10/1919 | Mergenthaler | 30/40.1 |
| 3,001,281 | 9/1961 | Nahon | 30/40.1 X |
| 3,381,374 | 5/1968 | Prouty | 30/40.1 |
| 3,596,353 | 8/1971 | Day | 30/43.6 |

FOREIGN PATENT DOCUMENTS

| | | | |
|---|---|---|---|
| 1,174,652 | 7/1964 | Fed. Rep. of Germany | 30/43.6 |
| 18,467 of | 1897 | United Kingdom | 30/43.6 |

*Primary Examiner*—Gary L. Smith

*Attorney, Agent, or Firm*—Frank R. Trifari; Rolf E. Schneider

[57] ABSTRACT

A shaving apparatus having a continuously driven endless band cutter, a stationary upper cutter with hair entrance apertures, and a stationary lower cutter with recesses corresponding to the apertures in the stationary upper cutter, the endless band cutter being disposed between the stationary lower cutter and the stationary upper cutter. Preferably, stops are mounted on at least one of the stationary lower cutter and the stationary upper cutter to space them apart, with the resulting spacing being slightly greater than the endless band cutter thickness.

4 Claims, 6 Drawing Figures

SHAVING APPARATUS WITH BAND CUTTER

This invention relates to a shaving apparatus comprising a driven endless band cutter and a stationary upper cutter in which hair entrance apertures are formed.

Such a shaving apparatus is known from U.S. Pat. No. 3,596,353. In this shaving apparatus the endless cutting band is pressed against the upper cutter by means of pressure members. These pressure members engage the cutting band at those locations where the hairs are not cut, namely in between rows of apertures. A drawback of this construction is that at the locations where cutting takes place the cutting band is not supported and may consequently be bent as a result of the forces produced during cutting, so that the cutting result is adversely affected.

It is an object of the invention to provide a solution for this problem and the invention is characterized in that the apparatus has a stationary lower cutter in which recesses are formed, which recesses correspond to the apertures of the upper cutter, the band cutter being disposed between the upper cutter and the lower cutter. During cutting the band cutter is passed between the lower cutter and the upper cutter, the forces which are produced in a direction perpendicular to the band cutter cancelling each other. In order to enable hair cutting, the recesses in the lower cutter should correspond to the apertures in the upper cutter.

A preferred embodiment is characterized in that the lower cutter is urged towards the upper cutter by spring force.

A further embodiment is characterized in that the distance between the upper cutter and the lower cutter is determined by stops, which distance is greater than the band cutter thickness. The band cutter in this embodiment is passed between the lower cutter and the upper cutter with a slight play. The fraction losses are then small. Preferably the stops are constituted by cams on at least one of the stationary cutters, which cams are situated on both sides or edges of the band cutter and extend to the facing or opposed stationary cutter. Should the cutters be flexed, the distance between the upper cutter and lower cutter will therefore not change, so that the friction losses will not increase.

Figure 2:
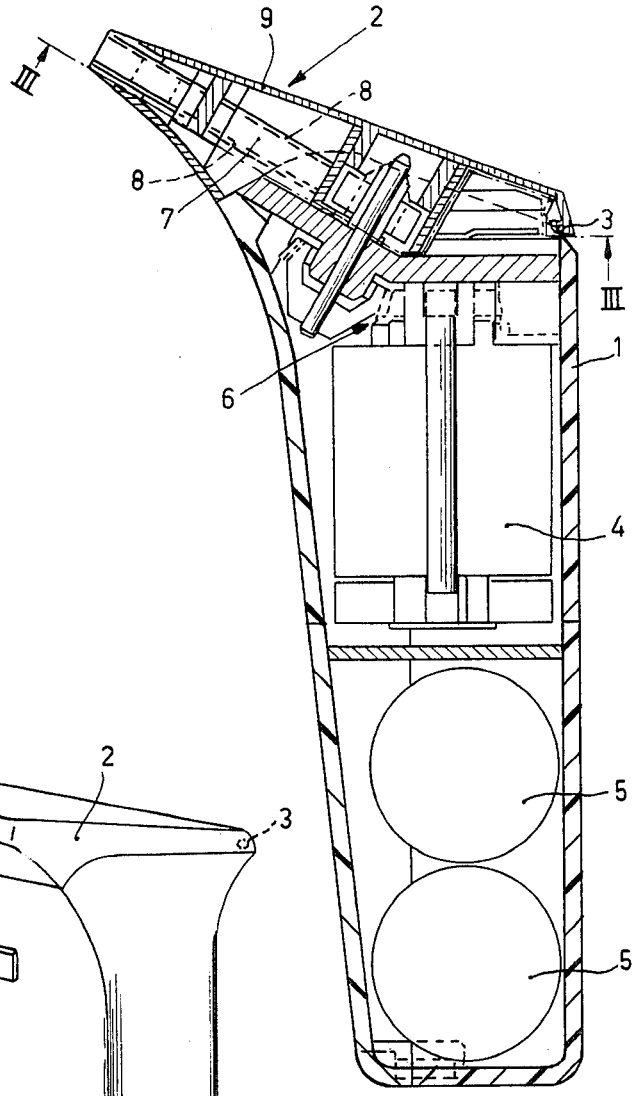
Figure 1:
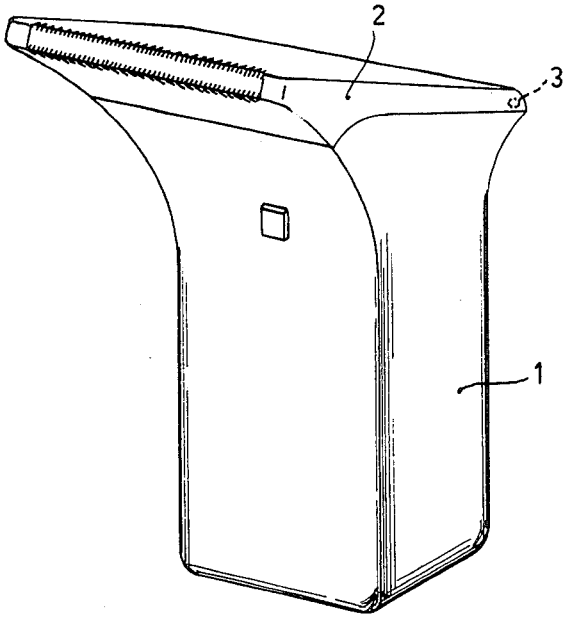
Figure 3:
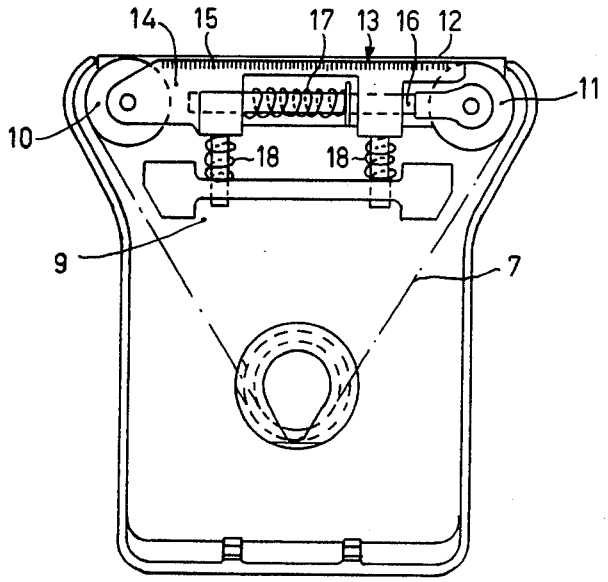
Figure 4:
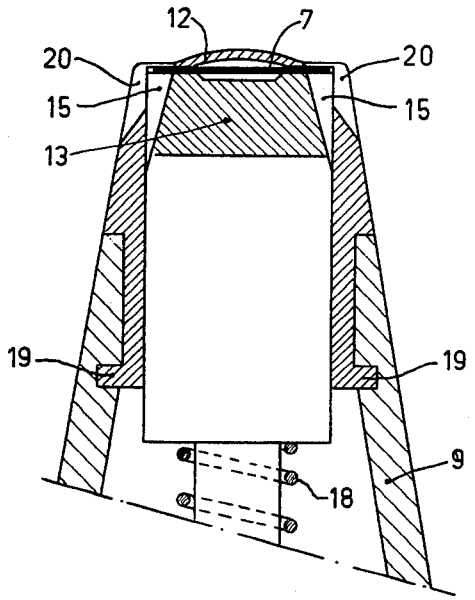
Figure 5:
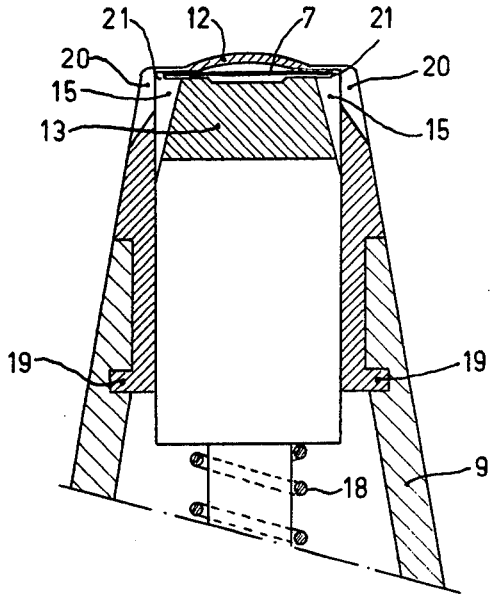
Figure 6:
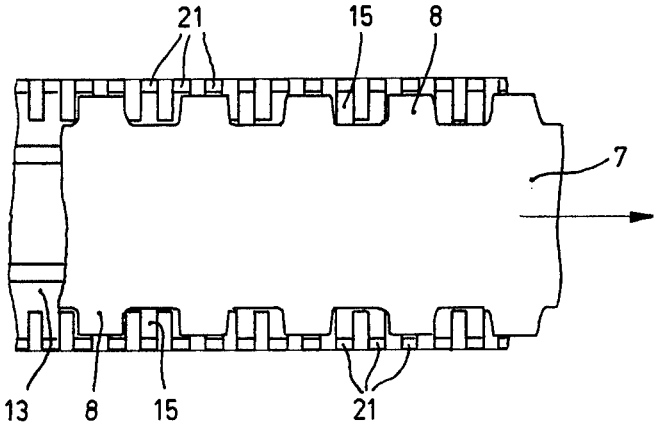

The invention will now be described in more detail by way of example with reference to the embodiments shown in the drawings, in which FIG. 1 is a perspective view of the shaving apparatus, FIG. 2 is a cross-section of the shaving apparatus, FIG. 3 is a sectional view taken on the line III—III of FIG. 2, FIG. 4 is a sectional view of the shaving head on a substantially enlarged scale, FIG. 5 is a sectional view also on an enlarged scale, of the shaving head in a different embodiment, and FIG. 6 is a plan view on a further enlarged scale, of the shaving head of FIG. 5 with the upper cutter removed.

The shaving apparatus of FIGS. 1 and 2 comprises a housing 1 and a shaving head 2. The shaving head is pivotably connected to the housing by means of a pivoting spindle 3, thus giving access to the interior of the shaving head. The housing 1 accommodates a motor 4 which is powered by means of batteries 5. The motor drives an endless band cutter 7 via a transmission mechanism 6. The band cutter 7 has teeth 8 on both sides or edges (also see FIG. 6).

FIG. 3 is a longitudinal section of the shaving head. The band cutter 7 is passed between the stationary upper cutter 12 and the stationary lower cutter 13 over a roller 10 which is rigidly mounted in the housing 9 of the shaving head and a resilient roller 11. The lower cutter 13 consists of a cutting block 14 with teeth 15 at the top. The cutting block 14 can pivot about the spindle of the roller 10. The spindle of the roller 11 is slidable in the cutting block 14 by means of a rod 16 and is urged outwards by a spring 17, thus keeping the band cutter 7 taut. The cutting block 14 is urged towards the upper cutter 12 by the spring 18.

FIG. 4 is a substantially enlarged cross-section of the shaving head. The upper cutter 12 is substantially U-shaped and is clamped in the housing 9 of the shaving head with the aid of cams 19. The upper cutter has openings 20 at the corners, which openings correspond to the recesses between the teeth of the lower cutter 13. The teeth 15 and the openings 20 are obtained by means of oblique sawcuts. The oblique slots facilitate the entry of beard hairs. Forces produced during cutting in a direction perpendicular to the band cutter cancel each other, so that each cutting slot is as small as possible. The springs 18 ensure a satisfactory contact between the band cutter and the lower cutter and the upper cutter respectively.

In a different embodiment (FIGS. 5 and 6) the lower cutter and the upper cutter are spaced from each other by cams 21 which are located on the teeth of the lower cutter 13. The height of the cams 21 is slightly greater than the thickness of the bank cutter 7. The band cutter is disposed in the slot formed between the lower cutter and the upper cutter. Owing to the slight play of the band cutter 7 in the slot, the friction between the moving band cutter and the stationary lower cutter and the stationary upper cutter is now small. The springs 18 ensure that the lower cutter with the cams correctly engages with the upper cutter, so that the gap height is constant.

The band cutter may be driven continuously in the same direction or with a continually changing direction of movement.

I claim:

1. A shaving apparatus which comprises a driven endless band cutter, means to drive said endless band cutter continuously, a stationary upper cutter having hair entrance apertures and a stationary lower cutter formed with recesses corresponding respectively to the apertures in the stationary upper cutter, the endless band cutter being disposed between the stationary upper cutter and the stationary lower cutter.

2. A shaving apparatus according to claim 1, which includes spring means for urging the stationary lower cutter towards the stationary upper cutter.

3. A shaving apparatus according to claim 1, which includes stops mounted on at least one of the stationary upper cutter and the stationary lower cutter to space them apart, the resulting spacing being greater than the endless band cutter thickness.

4. A shaving apparatus according to claim 3, in which the stops comprise cams positioned on at least one of the stationary cutters along both edges of the endless band cutter and extending to the opposing stationary cutter.

* * * * *